United States Patent [19]

Gershuni et al.

[11] Patent Number: 4,842,052

[45] Date of Patent: Jun. 27, 1989

[54] COOLER

[75] Inventors: Alexandr N. Gershuni, Kiev; Valery S. Maisotsenko, Odessa; Vladilen K. Zaripov; Mikhail G. Semena, both of Kiev, all of U.S.S.R.

[73] Assignee: Kievsky Politekhnichesky Institut, Kiev, U.S.S.R.

[21] Appl. No.: 241,987

[22] PCT Filed: Nov. 16, 1987

[86] PCT No.: PCT/SU87/00129

§ 371 Date: Jul. 12, 1988

§ 102(e) Date: Jul. 12, 1988

[87] PCT Pub. No.: WO88/04022

PCT Pub. Date: Jun. 2, 1988

[30] Foreign Application Priority Data

Nov. 18, 1986 [SU] U.S.S.R. ..... 4148435

[51] Int. Cl.[4] ..... F28D 15/02; F25B 19/00

[52] U.S. Cl. ..... 165/104.11; 165/104.26; 165/911; 62/304; 62/316; 62/333

[58] Field of Search ..... 165/104.11, 104.26; 62/304, 316, 315, 333, 119

[56] References Cited

U.S. PATENT DOCUMENTS

| | | | |
|---|---|---|---|
| 1,999,074 | 4/1935 | Baldwin | 62/316 |
| 2,218,407 | 10/1940 | Meyerhoefer | 62/316 |
| 4,381,817 | 5/1983 | Brigida et al. | 165/911 |

FOREIGN PATENT DOCUMENTS

| | | | |
|---|---|---|---|
| 162333 | 12/1981 | Japan | 62/316 |
| 474122 | 6/1975 | U.S.S.R. | 165/911 |
| 1121551 | 10/1984 | U.S.S.R. . | |
| 2167550 | 5/1986 | United Kingdom . | |

*Primary Examiner*—Albert W. Davis, Jr.
*Attorney, Agent, or Firm*—Lilling & Greenspan

[57] ABSTRACT

The proposed cooler has the form of a thermal tube (1) with zones (2 and 3) for evaporation and condensation, respectively, and outer fins (4) in the zone (3). The cooler has a casing (5) open at one side to admit a flow of gas, the casing accommodating fins (4) so that ends thereof form with a wall of the casing (5) at the other side a cavity (A) to reverse the flow of gas. Adjacent fins (4) are hermetically connected into pairs (6), and form passages (7, 8) between each pair and inside each pair. Provided at the walls of the inner passages (8) is a capillary porous lining (9) ends of which are in contact with a liquid medium (10).

3 Claims, 1 Drawing Sheet

COOLER

FIELD OF THE INVENTION

This invention relates generally to refrigeration, and more particularly to coolers.

The invention can be used for cooling solid, liquid and gaseous substances, such as foodstuffs, medicinal and biological preparations, chemical substances, and the like.

In addition, the invention can be used for ensuring temperature operating conditions of heat-stressed elements of equipment, instruments and apparatus.

STATE OF THE ART

There are known coolers of substances in the form of a thermal tube with evaporation and condensation zones Heat is drawn off the substance being cooled in the evaporation zone, whereas in the condensation zone heat is transferred to a cooling medium. A disadvantage of this device resides in the failure of attaining a cooling effect, that is attaining at the surface of such a tube a temperature, which would be below the temperature of the cooling medium. Another disadvantage is a rather small heat transfer surface area between the thermal tube and the surrounding medium, which results in a sharply limited capacity of the tube to provide desired thermal conditions and low magnitude of heat flow transferred by the thermal tube as a heat transfer element between the flows of "hot" and "cold" media. This disadvantage is most manifest under conditions of gas flows passed over the housing in the zones of evaporation and condensation of the thermal tube.

There is known a cooler in the form of a thermal tube (cf., S.Chi "Teplovye truby. Teoria i praktika", in Russian, Moscow, the Mashinostroenie Publishers, 1981, pp. 39 and 40, FIGS. 1.24, 1.25) comprising a casing with an evaporation zone in which heat is drawn off the substance being cooled, and a condensation zone having outer fins cooled by the flow of gas. In this cooler one of the above disadvantages is obviated, viz., the surface of heat transfer with the flow of gas is substantially increased thanks to the provision of outer fins. As the aforedescribed device, this one allows to cool the substance to a certain temperature, which, however, exceeds the temperature of the cooling medium. However, this cooler fails to cool the substance to a temperature below the temperature of the cooling medium, that is fails to obtain a cooling effect. One more disadvantage of this prior art device is that a higher cooling efficiency can be attained (at a preset inner thermal resistance of the thermal tube and preset temperature of the cooling medium) only through increasing the surface area of outer fins and more vigorous transfer of heat to the flow of gas, which results in a greater weight, size, amount of metal consumed for the fabrication of the cooler, and amount of power consumed by fan drives. Also, such an arrangement can be followed to certain limits dictated by the physical characteristics governing the processes of heat transfer.

Cooling effect is attained by a range of various types and structure of cooling machines and apparatus. However, these apparatus have such inherent disadvantages as much power consumed during operation, complications associated with manufacture, operation and repairs resulting in substantial production and operation costs, and ecological hazards associated with the use of freon, ammonia and other toxic substances as cooling agents.

SUMMARY OF THE INVENTION

It is an object of the present invention to obviate disadvantages inherent in the prior art cooler constructions.

The invention aims at providing a cooler of substances in the form of a thermal tube of such structural arrangement as to ensure cooling effect enabling an increase in the efficiency of cooling.

The aims of the invention are attained by that in a cooler having the form of a thermal tube comprising an evaporation zone where heat is drawn off a substance to be cooled, and a condensation zone having outer fins passed over by a flow of gas, according to the invention, it has a casing open at one side for admitting a flow of gas and accommodating the fins so that their ends define with a wall of the casing at the other side a cavity where the flow of gas is reversed, adjacent fins at the side of admission of the gas being connected hermetically into pairs to form passages between each such pair and inside each such pair, walls of the thus formed inner passages having a capillary porous lining ends of which are in contact with a liquid medium.

Preferably, the casing accommodates a vessel containing water. desirably, holes for discharging the used gas to the outside are provided at the casing in the zones of the inner passages at the point of hermetic connection of the fins into pairs.

Thanks to the aforedescribed arrangement of the cooler it is possible to attain a cooling effect, that is to cool the substance to a temperature below the temperature of the cooling medium and thereby increase the efficiency of cooling.

The essence of the invention resides in the following. Because the proposed cooler of substances has a casing open at one side, whereas the other side thereof is provided with a cavity to reverse the flow of gas, and the fins are connected so that passages are formed therebetween, the following becomes possible. The flow of gas can at first be directed to the passages (between each pair of fins) defined between adjacent fins hermetically connected into pairs, and then after egress from these passages the flow can be turned in the cavity formed by the ends of the fins and wall of the casing and directed in a counterflow to the inner passages of each pair of ribs. The capillary porous lining at the walls of the inner passages can be impregnated with a liquid medium. Then the flow of gas in these passages causes vaporization of the liquid from the lining. As a result, heat is drawn off the fins and surface of the thermal tube in the condensation zone, whereby; (a) a temperature gradient arises between the condensation and evaporation zones for the thermal tube to start functioning according to the known evaporation-condensation cycle and draw off heat from the substance being cooled; and (b) simultaneously, the flow of gas conveyed to the pasasges between the pairs of fins and moving in a counterflow to the flow of gas in the inner passages is preliminarily cooled.

The thus pre-cooled flow of gas, while entering the inner passages, causes reduction in the temperature of the fins, is heated, humidified, and is discharged to the outside. Reduced temperature of the fins again causes reduction in the temperature of the evaporation zone and that of the substance being cooled, as well as provides additional cooling of the flow of gas in the passages between the pairs of fins. As a result of the aforedescribed sequence of the process, the temperature of the substance is lowered to a point below the temperature of the incoming flow of gas, whereby a cooling effect is attained. In view of the aforedescribed, the specific features of the proposed cooler provide a unique cycle of evaporative cooling in which a cooled gas (such as air) is conveyed to the inner passages from the passages between the pairs, rather than from the surrounding environment (as is in the conventional cycle), which enables, as distinct from the conventional cycle, to bring down the cooling level to temperatures below the wet bulb point of the atmospheric air.

When the substance being cooled liberates continuously substantial amounts of heat, the proposed device can reduce its temperature to a point exceeding the temperature of the incoming air, although with a higher cooling efficiency as compared with the known coolers fashion ed as thermal tubes. Otherwise stated, the substance can be cooled to a temperature substantially lower than that ensured by the similar prior art apparatuses.

In order to increase the time of continuous operation of the proposed cooler without refilling it with a liquid medium, the cooler has a vessel containing water.

For increasing the surface of the capillary porous lining passed over by air, holes for discharging the used gas to the atmosphere are preferably provided at the casing in the zones of the inner passages at the point of hermetic connection of the fins into pairs.

The herein proposed cooler therefore features a number of advantages over the similar prior art apparatus. For example, a cooler embodying the aforedescribed features, which includes a copper thermal tube 14 mm in diameter with evaporation and condensation zones 150 mm in length each having at the surface of the condensation zone transverse rectangular copper fins sizing 100×70 mm, 0.5 mm thick and spaced from each other a distance of 3 mm ensures at a temperature of the incoming air of 20° C., relative air humidity of 50%, and flow rate of 25 kg/h a temperature at the surface of the thermal tube in the evaporation zone of 14.6° C., that is 5.4° C. less than the temperature of the incoming flow of air. When an object liberating 300 W of heat is placed at the surface of the evaporation zone, its temperature will be 38° C. lower than the temperature of the same object placed on a prior art thermal tube of the same dimensions. For attaining the same temperature of the object being cooled the known thermal tube must have a condensation zone twice as long, mass 1.7 times greater, and flow rate of air 2.1 times higher than in the proposed cooler.

BRIEF DESCRIPTION OF THE DRAWINGS

The invention will now be described in greater detail with reference to various specific embodiments thereof taken in conjunction with the accompanying drawings, in which.

BEST MODE OF CARRYING OUT THE INVENTION

Figure 1:
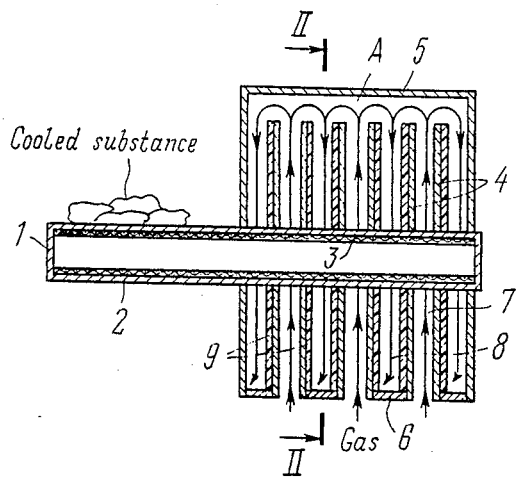
FIG. 1 is a longitudinal sectional view of the proposed cooler.
Figure 2:
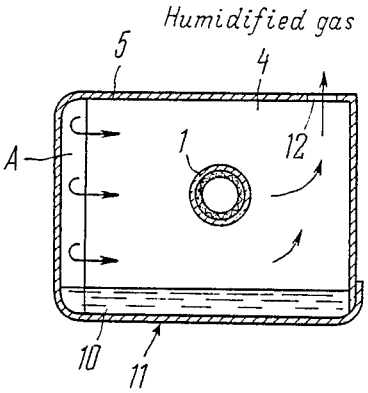
FIG. 2 is a section taken along the line II—II in FIG. 1.

Referring to FIGS. 1 and 2, the proposed cooler has the form of an axial thermal tube 1 with zones 2 and 3 of evaporation and condensation, respectively. Provided at the surface of the condensation zone 3 are transverse rectangular fins 4. The cooler has a casing 5 open to admit a flow of gas (such as air) at one side. The casing 5 accommodates the fins 4. The fins 4 are arranged so that their ends form with the wall of the casing 5 at the side opposite to the side of admission of the flow of air a cavity A for reversing the flow of air. Adjacent fins 4 at the side of admission the air are hermetically connected into pairs 6 to define passages 7 between each pair and passages 8 inside each such pair. The walls of the inner passages 8 have capillary porous lining 9 made immediately on the fins 4 or applied thereto and bonded therewith by any known suitable method. Ends of the capillary porous lining 9 are in contact with a liquid medium 10, in this case water, present in a vessel 11 provided inside the casing 5. Provided also at the casing 5 in the zones of the inner pasasges 8 at the point of hermetic connection of the fins into pairs are holes 12 for the used air to escape therethrough to the outside.

The proposed cooler operates in the following manner. A flow of outside air is fed to the passages 7 between each pair 6 of fins 4 to flow therealong and enter the cavity A, where it is turned and directed to the inner passages 8. In the inner passages 8 the air is conveyed in a counterflow to the flow of air in the passages 7. While flowing about the moist capillary porous lining 9 wettable due to its contact with the water 10 present in the vessel 11, the air causes vaporization of moisture, whereby heat is drawn off the fins 4 and off the inner surface of the zone 3 of the thermal tube on which the fins are mounted. The flow of used humid air escapes to the outside through the holes 12. By virtue of this process the surface of the thermal tube in the evaporation zone 2 and the substance being cooled in contact therewith become the source of heat with respect to the condensation zone 3, i.e., heat sink, and the thermal tube starts to function according to the working evaporation-condensation cycle withdrawing heat from the substance being cooled. If the initial temperature of the substance being cooled is equal to or even somewhat in excess of the temperature of air admitted to the passages 7, then this substance is cooled to a temperature below the temperature of the incoming air, and the apparatus provides a cooling effect. On the other hand, if the substance or an object contacting with the surface in the evaporation zone 2 is characterized by a substantial continuous liberation of heat, the apparatus provides such a thermal condition of the substance or object as to ensure a higher thermal efficiency, as compared with the prior art cooler constructions.

Another alternative embodiment of the structural arrangement of the proposed apparatus can have the form of a thermal tube with longitudinally extending fins in the condensation zone. In this case the flow of gas in the passages is parallel with the axis of the thermal tube.

Figure 3:
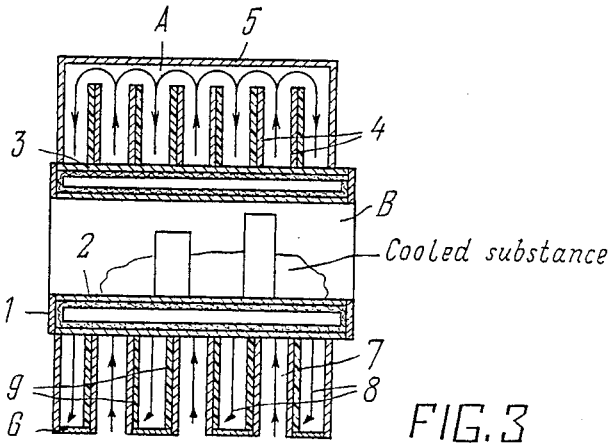
FIG. 3 shows a longitudinal sectional view of another embodiment of the cooler according to the invention.

FIG. 3 illustrates one more modified form of the cooler according to the invention fashioned as a coaxial thermal tube. In this modification the evaporation zone 2 and condensation zone 3 have the form of coaxial shells, whereby heat is transferred from the evaporation zone to the condensation zone radially, rather than axially as is the case in the modification with reference to FIGS. 1 and 2. This allows accommodation within the overall dimensions of the apparatus a functional and conveniently arranged refrigerating chamber B for cooling the substance. Structural elements and operation of this modification are substantially similar to the aforedescribed.

One more alternative embodiment is possible, where the cooler has the form of a set of thermal tubes with condensation zones thereof having common outer fins enclosed by a casing.

It stands to reason that the scope of the present invention is not limited by heretofore described and illustrated embodiments, and that other alternative embodiments of the proposed cooler are possible without departing from the spirit and scope of the invention.

INDUSTRIAL APPLICABILITY

The invention can be used for designing and manufacturing a range of coolers of substances and refrigerators for industrial and domestic application, such as stationary, mobile, gauged up with vehicles, etc. These machines can be intended for cooling foodstuffs, farm products, medicinal and biological preparations, chemical substances. In addition, the invention can be inducive to developing highly efficient means for taking heat off various heatstressed equipment and instruments.

Cooler constructions embodying the present invention are characterized by low consumption of power, reliability, simplicity, light weight, small size and ecological safety.

We claim:

1. A cooler having the form of a thermal tube (1) comprising an evaporation zone (2) in which heat is drawn off a substance to be cooled, and a condensation zone (3) having outer fins (4) passed over by a flow of gas, characterized in that it has a casing (5) open at one side for admitting a flow of gas and accommodating the fins (4) so that their ends define with a wall of the casing (5) at the other side a cavity (A) to reverse the flow of gas, adjacent fins (4) at the side of admission of the gas being connected hermetically into pairs (6) to form passages (7, 8) between each such pair and inside each such pair walls of the thus formed inner passages (8) having a capillary porous lining (9) ends of which are in contact with a liquid medium (10).

2. A cooler as claimed in claim 1, characterized in that the casing (5) accommodates a vessel (11) containing water.

3. A cooler as claimed in claim 1, characterized in that holes (12) for discharging the used gas to the outside are provided at the casing (5) in the zones of the inner passages (8) at the point of hermetic connection of the fins (4) into pairs.

* * * * *